US008604927B2

(12) United States Patent
Sisney

(10) Patent No.: US 8,604,927 B2
(45) Date of Patent: Dec. 10, 2013

(54) RETRACTABLE MERCHANDISE SECURITY TETHER WITH ALARM

(75) Inventor: Scott W. Sisney, Rockford, IL (US)

(73) Assignee: Southern Imperial, Inc., Rockford, IL (US)

( * ) Notice: Subject to any disclaimer, the term of this patent is extended or adjusted under 35 U.S.C. 154(b) by 300 days.

(21) Appl. No.: 13/081,695

(22) Filed: Apr. 7, 2011

(65) Prior Publication Data

US 2012/0256747 A1 Oct. 11, 2012

(51) Int. Cl.
*G08B 13/12* (2006.01)
*H01H 9/00* (2006.01)

(52) U.S. Cl.
USPC ..... 340/568.2; 200/61.13

(58) Field of Classification Search
USPC ..... 340/568, 665, 572.1–572.9, 568.2, 531, 340/573.4, 10.1; 200/61.13
See application file for complete search history.

(56) References Cited

U.S. PATENT DOCUMENTS

| | | | | |
|---|---|---|---|---|
| 5,124,685 | A * | 6/1992 | Rankin | 340/568.2 |
| 7,081,822 | B2 * | 7/2006 | Leyden et al. | 340/635 |
| 7,403,117 | B2 * | 7/2008 | Leyden et al. | 340/568.2 |
| 8,077,037 | B2 * | 12/2011 | Leyden et al. | 340/568.2 |
| 8,368,543 | B2 * | 2/2013 | Yang | 340/572.8 |
| 8,373,566 | B2 * | 2/2013 | Yang | 340/572.9 |
| 2006/0238342 | A1 * | 10/2006 | Leyden et al. | 340/568.2 |
| 2009/0058643 | A1 * | 3/2009 | Groth | 340/568.1 |
| 2010/0171621 | A1 * | 7/2010 | Yang | 340/572.9 |
| 2010/0315239 | A1 * | 12/2010 | Yang | 340/572.9 |

FOREIGN PATENT DOCUMENTS

| | | | | |
|---|---|---|---|---|
| GB | 2 187 017 A * | 8/1987 | | G08B 13/14 |

* cited by examiner

*Primary Examiner* — Benjamin C Lee
*Assistant Examiner* — Sigmund Tang
(74) *Attorney, Agent, or Firm* — Reinhart Boerner Van Deuren P.C.

(57) ABSTRACT

A retractable merchandise security tether with alarm is provided. The security tether includes a housing carrying a spool for winding an unwinding a cable therefrom. A security module is also packaged within the housing. The security module includes a sensor operable to detect the presence of a severed end of the cable within the housing. Upon detection, the security arrangement is operable to provide an indication of the presence of the severed end in the form of an alarm or other indication.

14 Claims, 9 Drawing Sheets

RETRACTABLE MERCHANDISE SECURITY TETHER WITH ALARM

FIELD OF THE INVENTION

This invention generally relates to loss prevention in a retail environment, and more particularly to security devices for deterring retail theft, and even more particularly to retail merchandise tethering devices.

BACKGROUND OF THE INVENTION

Loss prevention continues to be an issue facing retailers. Many contemporary systems have been employed to deter or entirely prevent retail theft. For example, certain items of merchandise may be secured in a locked cabinet. Access to the locked cabinet is typically restricted to store employees. As a result, when a consumer wants to inspect the goods in the cabinet, they must locate a store employee, and the employee must retrieve the goods from the cabinet.

Unfortunately, many potential customers who desire to inspect a locked away item prior to purchase grow impatient waiting for an employee to retrieve it from the locked cabinet. As a result, costumers often times abandon their decision to purchase a locked away item because they grow tired of waiting for someone to retrieve it.

One solution to this problem is the retractable tether. Retractable tethers are often affixed to merchandise such as cameras or other small electronics. In design, the retractable tether includes a base unit that has a spool with a cable on "tether" wound thereabout. An end of the tether is affixed to the merchandise. A customer can handle the merchandise, and as this handling occurs, the tether will unwind to permit movement of the merchandise in proximity to the base unit. However, the merchandise may only be moved away from the base unit up to the maximum unwound length of the tether. As the customer moves the merchandise back toward the base unit, the tether is automatically retracted by the spool in the base unit to maintain the tether in a neat and orderly fashion.

Unfortunately, the aforementioned tethering devices, while allowing the customer to handle merchandise, are prone to retail theft. More specifically, it has been found that thieves simply cut the tether, and remove the electronic device from the store.

Due to these above deficiencies, there is a need in the art for a retractable retail merchandise tether that allows a customer to handle merchandise affixed to the tether, but will also deter severing of the tether by way of an alarm system or configuration.

The invention provides such a tethering device. These and other advantages of the invention, as well as additional inventive features, will be apparent from the description of the invention provided herein.

BRIEF SUMMARY OF THE INVENTION

In one aspect, embodiments of the present invention provide a retail merchandise security tether for deterring and substantially reducing retail theft. A retail merchandise tether according to this aspect includes a housing having an internal cavity. An extendable and retractable tether extends from the internal cavity of the housing. The tether is adapted to secure an item of retail merchandise. A security module is also mounted to the housing. The security module is operable to detect the presence of a severed end of the tether within the housing.

In certain embodiments, the security module includes a sensor in electronic communication with an indicator. The sensor is mounted to the housing to detect the presence of a severed end of the tether. The indicator is adapted to provide an indication upon detection of the severed end.

In certain embodiments, the sensor includes a pair of electrical contacts. The tether has an operating length and a severed length shorter than the operating length. The pair of electrical contacts do not contact one another when the tether is at the operating length. In further embodiments, the pair of electrical contacts do contact one another when the tether is at the severed length.

In certain embodiments, one of the pair of contacts is formed by the severed end of the tether. The other one of the pair of contacts is formed by a contact wall mounted within the internal cavity of the housing.

In certain embodiments, the housing has an opening. One of the pair of electrical contacts is formed by a spring loaded door arranged relative to the opening. The other one of the pair of electrical contacts is a contact wall arranged by the opening such that the spring loaded door will bias shut over the opening and contact the contact wall when the tether is at the severed length.

In certain embodiments, the tether extends from the housing along an extension path. The sensor is a proximity sensor mounted in proximity to the extension path to detect a presence of the tether along the extension path.

In another aspect, embodiments of the invention provide a retail merchandise security tether. A retail merchandise security tether according to this aspect includes a housing having an opening. An extendable and retractable tether is mounted on a spool carried within the housing. The tether extends through the opening. A sensor is also mounted to the housing and arranged about the opening. The sensor is operable to detect movement of a severed end of the tether from an exterior of the housing to an interior of the housing through the opening.

In certain embodiments, the sensor is a pair of electrical contacts. In one embodiment, each one of the pair of electrical contacts are in electrical communication with a controller of the retail merchandise tether. The controller is operable to detect when the pair of contacts are opened and closed. The controller is also configured to send a signal to an indicator to provide an alert notification when the pair of contacts are closed.

In certain embodiments, one of the pair of electrical contacts is a wall substantially surrounding the spool. The wall has a wall opening formed therein to permit extension and retraction of the tether through the opening of the housing. In certain embodiments, the other one of the pair of electrical contacts is the tether.

In certain embodiments, one of the pair of electrical contacts is a movable door positioned over the opening of the housing. The movable door is operable to close off the opening upon the complete retraction of the tether into the housing. The second contact is a contact wall positioned around the opening.

In certain embodiments, the sensor is a proximity sensor positioned adjacent to the opening. The proximity sensor is operable to detect movement of the tether.

In yet another aspect, embodiments of the invention provide a method for detecting a potential theft of an item of retail merchandise situated in a retail store. A method according to this aspect includes affixing an item of retail merchandise to a merchandise tether that is extendable and retractable from a housing. The method further includes extending and retracting the tether from the housing when the item is moved away and toward the housing. The method also includes detecting a severed end of the tether.

In certain embodiments, the method further includes providing an indication that the tether has been severed. In certain embodiments, providing an indication includes generating an audible alarm. In certain embodiments, providing an indication includes generating a visual alarm. In certain embodiments, providing an indication includes communicating with a security system of the retail store.

In certain embodiments, detecting the severed end of the tether includes completing an electrical circuit between a pair of electrical contacts.

In yet another aspect, embodiments of the invention provide a security device for a retail merchandise tether. Such a security device includes a housing having a first opening. The housing defines a tether passageway. A security module is mounted within the housing. The security module includes a sensor arranged about the opening to detect the presence of the merchandise tether.

In certain embodiments, the sensor includes a first and a second electrical contact. In certain other embodiments, the first electrical contact is a spring loaded contact arranged over the first opening. The second electrical contact is a contact wall arranged adjacent to the first opening.

In certain embodiments, the security module includes a controller. The controller is in electronic communication with both of the first and second contacts such that the controller detects when the first and second contacts are in an abutted contacted. The controller is also operable to detect when the first and second contacts are not in abutted contact.

In certain embodiments, the tether passageway includes an inlet and an outlet. The inlet is the first opening and the outlet is a second opening through the housing. The second opening is in opposed spaced relation to the first opening such that the first and second openings are formed on opposing sides of the housing. The first and second openings are arranged to permit movement of the tether relative to the housing.

Other aspects, objectives and advantages of the invention will become more apparent from the following detailed description when taken in conjunction with the accompanying drawings.

BRIEF DESCRIPTION OF THE DRAWINGS

The accompanying drawings incorporated in and forming a part of the specification illustrate several aspects of the present invention and, together with the description, serve to explain the principles of the invention. In the drawings.

While the invention will be described in connection with certain preferred embodiments, there is no intent to limit it to those embodiments. On the contrary, the intent is to cover all alternatives, modifications and equivalents as included within the spirit and scope of the invention as defined by the appended claims.

DETAILED DESCRIPTION OF THE INVENTION

Figure 1:
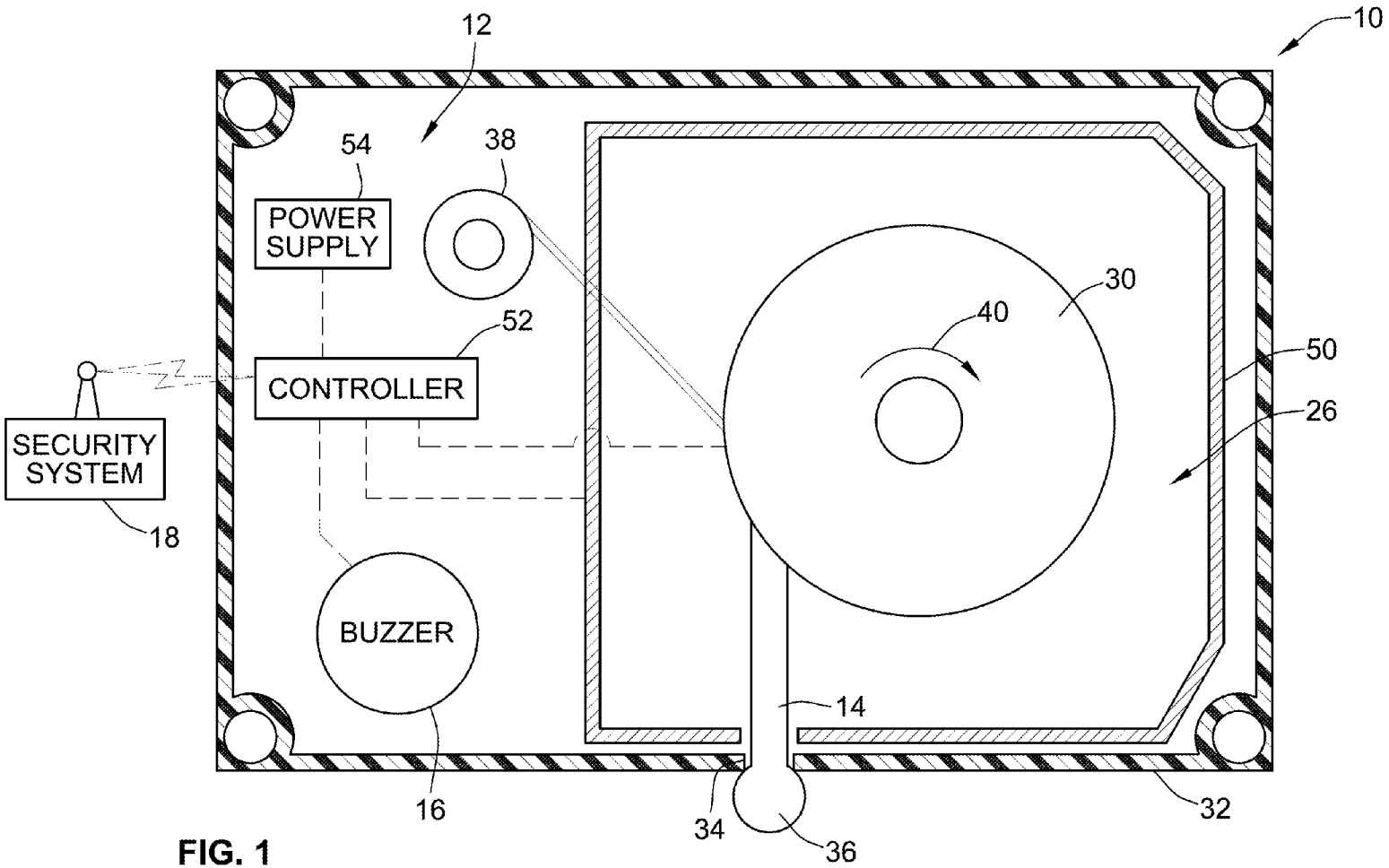
FIG. 1 is a front cross section of an exemplary embodiment of a retractable merchandise security tether with alarm.

Turning now to the drawings, there is illustrated at FIG. 1 an exemplary first embodiment of a retractable merchandise security tether with alarm referred to hereafter as a security tether device 10. The security tether device 10 incorporates a security module 12. The security module 12 is operable to detect if a tether 14 of the security tether device 10 has been severed during a retail theft event. The tether 14 is said to be at a "operating length" when the tether 14 is unsevered and connected to an item of retail merchandise. The tether 14 is said to be at a "severed length" when the tether 14 has been severed short of where it ordinarily is affixed to an item of retail merchandise.

Upon detection, the security module 12 can provide an alert notification via an indicator 16. Additionally, or in the alternative, the security module 12 can also communicate with a security system 18 of a retail store or other environment to alert the system that the tether 14 has been severed.

The security module 12 and the tether 14 partially wound upon a spool 30 are packaged within a housing 32. The housing 32 is generally a two-piece construction, i.e., the housing 32 is formed from two identical halves that may be fastened to one another to contain the security module 12 and the partially wound portion of the tether 14 upon the spool 30.

The tether 14 is unwound from the spool 30 through an opening 34 of the housing 32. A terminal end 36 of the tether 14 is affixed to an item of merchandise (not shown) that is larger than the cable opening 34 of the housing 32. Such a configuration prevents the tether 14 from fully retracting into the housing 32 through the opening 34 when the tether 14 remains unsevered, or is at its operating length. However, as will be described in greater detail below, in the event that the tether 14 is in fact severed and the tether 14 retracts completely into the housing 32, the security module 12 will detect the presence of a severed end of the tether 14 within the housing 32 and provide an appropriate notification.

More specifically, during normal operation, the terminal end 36 of the tether 14 will be affixed directly, or alternatively via a mounting structure, to an item of retail merchandise. As the item of retail merchandise is moved away from the security tether device 10, the tether 14 will unwind from the spool 30. Additionally, a biasing element 38 mechanically connected to the spool 30 will bias the tether 14 back into the housing by biasing the spool 30 in a winding direction 40. The tether 14 may be a metal strand cable or any other conductive flexible member. Additionally, the tether 14 may not be wound on a spool at all, and instead be embodied as a coiled member possessing shape memory.

As a result, as the merchandise is moved back towards the security tether device 10, the tether 14 is taken up by the spool 30 in a neat and orderly fashion. However, in the event the tether 14 is severed, thereby detaching the retail merchandise from the security tether device 10, the tether 14 will completely retract into the housing 32. The security module 12 is operable to detect when the tether 14 has been severed, as will be explained in more detail below.

The security module 12 includes a sensor in the form of a pair of electrical contacts. In the illustrated embodiment of FIGS. 1 and 2, one of the electrical contacts is a contact wall 50 that surrounds the spool 30 but permits passage of the tether 14 through the opening 34 of the housing 32, and into an internal region 26 bounded by the contact wall 50. The other electrical contact is formed by the spool and/or tether 14.

The security module 12 also includes a controller 52 in electrical communication with the contact wall 50 as well as the spool 30 and/or tether 14. The security module 12 may also include a power supply 54 packaged within the housing 32. The power supply 54 is operable to provide power for the various security functionality described herein relative to the security module 12 and more particularly the controller 52 and indicator 16. Alternatively, the security tether device 10 may utilize an existing power supply of the retail environment, or multiple security tether devices 10 may use a common power supply.

Figure 2:
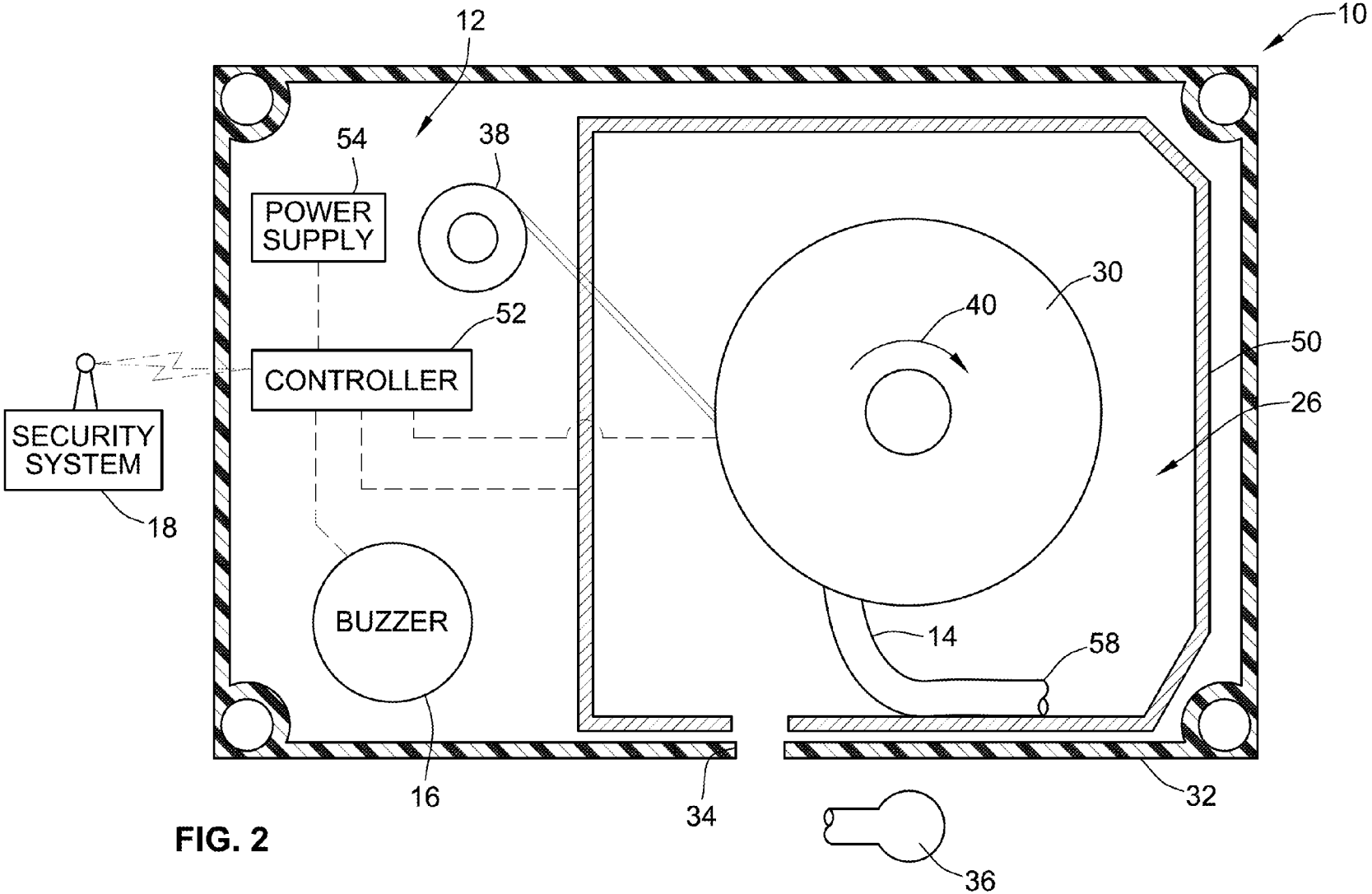
FIG. 2 is a front cross section of the embodiment of FIG. 1, with a severed end of a cable contacting a sensor within the housing of the embodiment of FIG. 1.

Turning now to FIG. 2, the security module 12 is operable to detect a completed electrical circuit formed between the tether 14 and the contact wall 50. More particularly, in the event the tether 14 is severed, a severed end 58 of the tether 14 will contact the contact wall 50 as the severed tether 14 is wound in direction 40 about the spool 30 and into the internal region 26 bounded by the contact wall 50. When the severed end 58 of the tether 14 contacts the contact wall 50, an electrical circuit is completed. The controller 52 is operable to detect the completion of this electrical circuit.

In response, the controller 52 is thereafter operable to send a signal to the indicator 16 to provide an alarm. This alarm may be audible, visual, or a combination of both. Indeed, the indicator 16 may be a sound or light emitting device, or a combination of both.

Further, the controller 52 is also operable to send a wired or wireless signal to a security system 18 of the retail store to provide additional security measures, e.g., focusing of security cameras, alerting security personnel via SMS message or other means, etc. It will be recognized that the above functionality advantageously alerts a retailer when a would be thief has severed the tether 14 in an attempt to remove the merchandise affixed to the tether.

Figure 3:
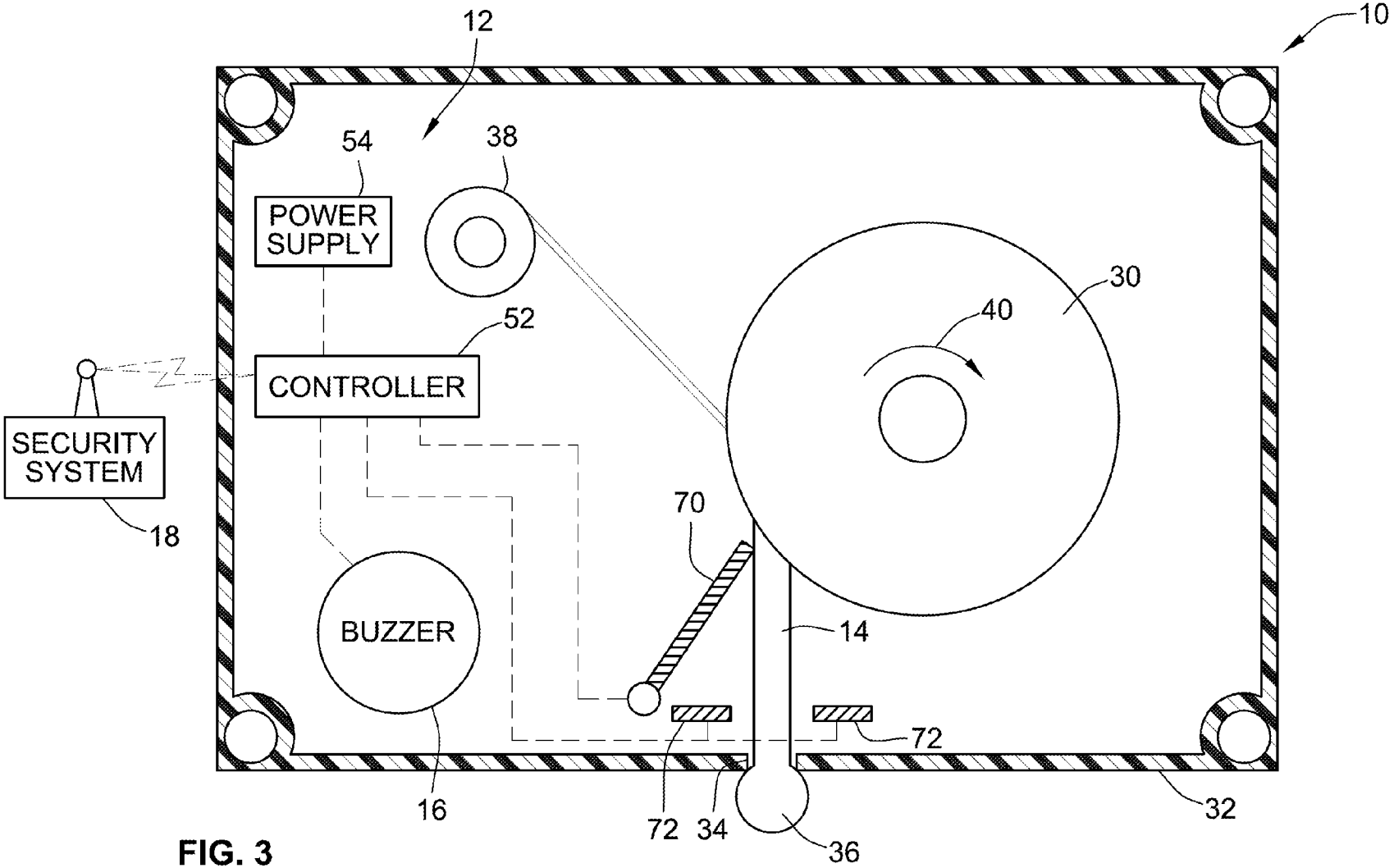
FIG. 3 is a front cross section of another embodiment of a retractable merchandise security tether with alarm.
Figure 4:
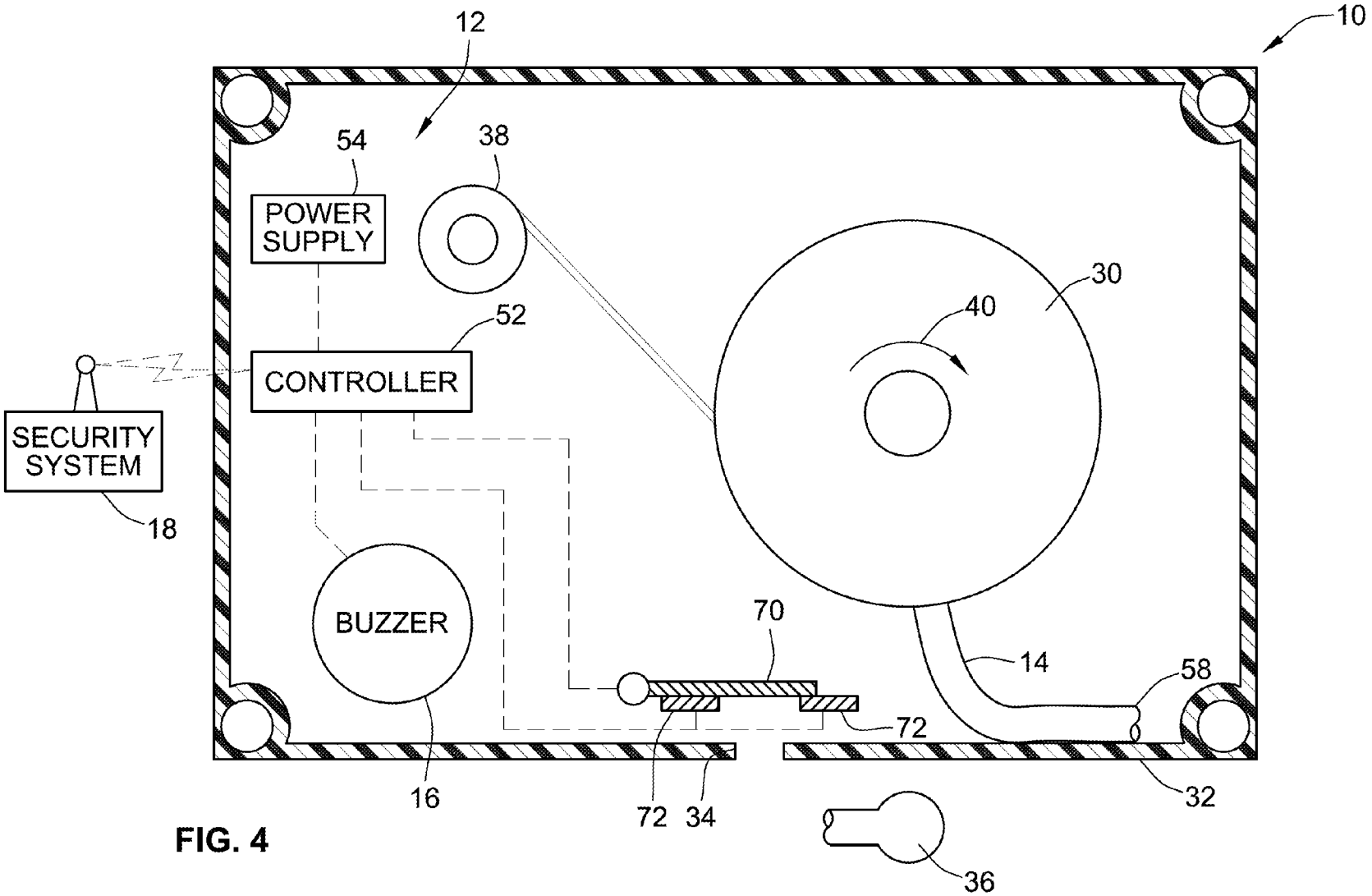
FIG. 4 is a front cross section of the embodiment of FIG. 3, with a severed end of a cable disposed internally within a housing of the embodiment of FIG. 3.

Referring now to FIGS. 3 and 4, a second embodiment of a security tether device 10 is illustrated. The second embodiment of the security tether device 10 is similar to the first embodiment described relative to FIGS. 1 and 2 above, with the exception that the security tether device 10 illustrated in FIGS. 3 and 4 incorporates a spring loaded sensor arranged about the opening 34 as described below.

The sensor illustrated in FIG. 3 includes a spring loaded contact 70 and a contact wall 72. The spring loaded contact 70 and contact wall 72 are arranged about the opening 34 of the housing 32. The contact wall 72 may be positioned on either side of the opening 34, or limited to one side.

When the tether 14 extends through the opening 34 during normal operation, the spring loaded contact 70 remains out of contact with the contact wall 72 as illustrated. The controller 52 is in electrical communication with the spring loaded contact 70 as well as the contact wall 72. As such, during normal operation when the tether 14 extends through the opening 34, the controller 52 detects an open circuit between the spring loaded contact 70 and contact wall 72.

Turning now to FIG. 4, in the event the tether 14 is severed, the tether 14 will be wound in direction 40 about the spool 30 such that it is completely taken up into the housing 32 through the opening 34. As a result, the tether 14 will no longer hold the spring loaded contact 70 in an open position relative to the contact wall 72 as illustrated in FIG. 3. Accordingly, an electrical circuit will be completed between the spring loaded contact 70 and contact wall 72. The controller 52 will detect the completion of the circuit, and provide an indication via indicator 16, and/or send an alert signal to the security system 18 of the retail store in a similar or same manner as described above. Therefore, this embodiment of a sensor incorporating a spring loaded contact 70 and contact wall 72 also is operable to detect when the tether 14 has been severed.

Figure 5:
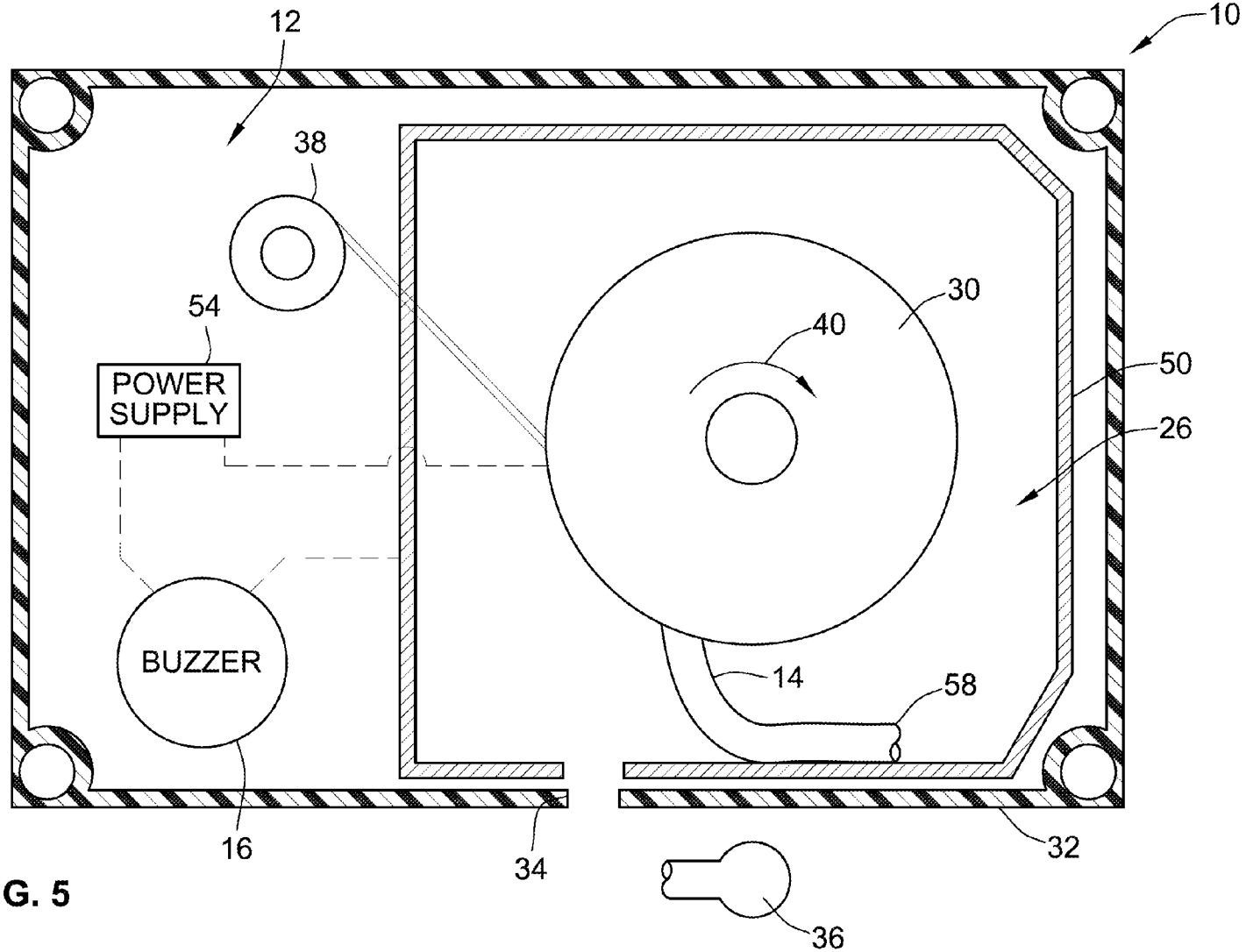
FIGS. 5-6 are front cross sections of an embodiment of a retractable merchandise security tether with alarm that does not incorporate a controller within a housing thereof.
Figure 6:
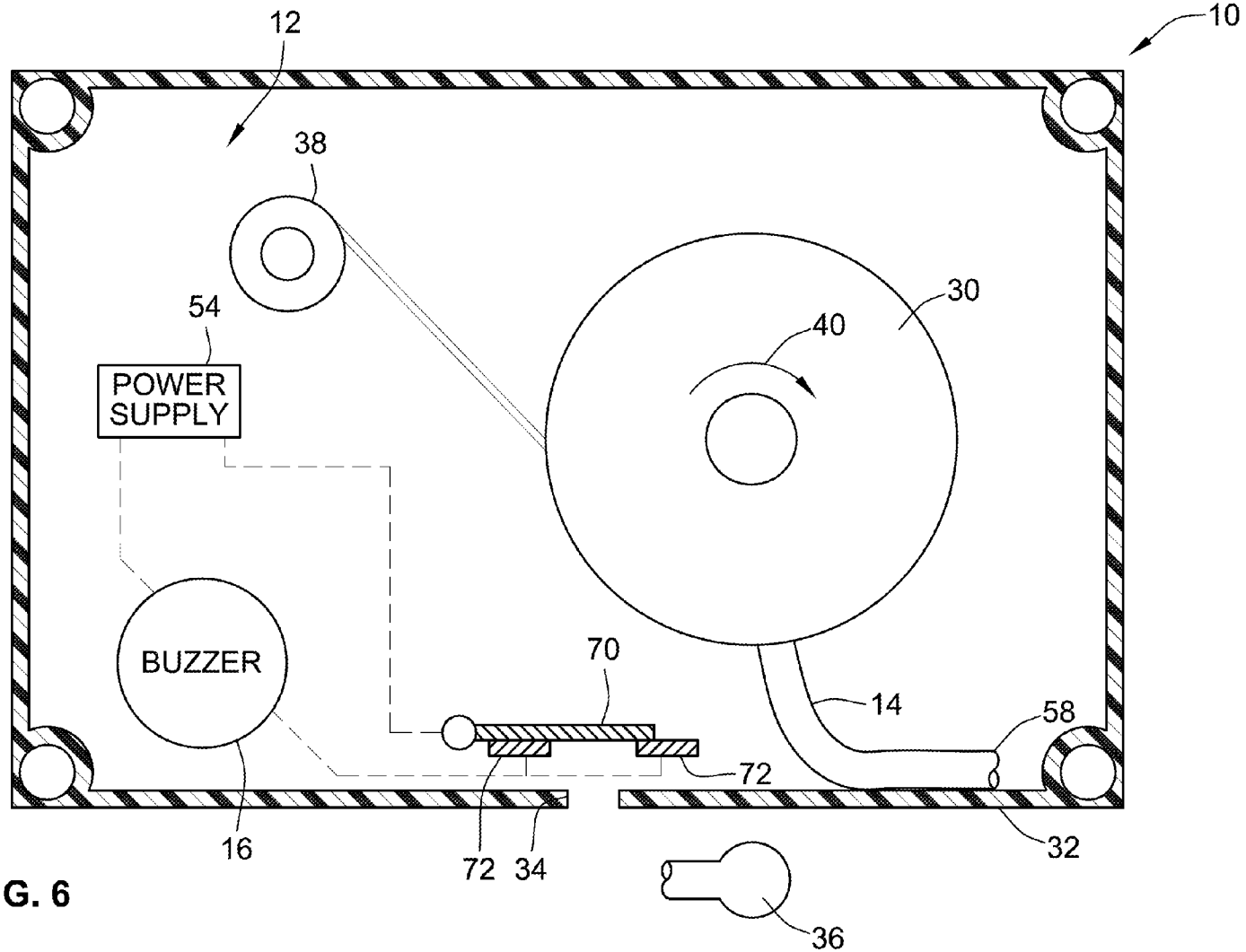

Turning now to FIGS. 5 and 6, further alternative embodiments of the security tether device 10 are illustrated. With respect to FIG. 5, it is contemplated that the controller 52 (see FIGS. 1-4) described above can be omitted. In this embodiment, the power supply 54 will be in direct electrical communication with the sensor, and more particularly one of the contact 50 or spool 30. The other one of the contact 50 or spool 30 will be in electrical communication with the indicator 16. One lead of the power supply 54 will also be in electrical communication with the indicator 16. As such, when the severed end 58 of the tether 14 contacts the contact wall 50, a power signal is sent through the spool 30 and tether 14 to the contact 50 and ultimately to the indicator 16. It will be recognized that this embodiment presents a simplified and compact arrangement that achieves the security advantages described above.

Similarly, the embodiment of FIG. 6 also omits a controller 52 (see FIGS. 1-4). In this embodiment, the power supply 54 is in electrical communication with the indicator 16. The power supply is also in electrical communication with one of the spring loaded contact 70 or contact wall 72. The other one of the spring loaded contact 70 or contact wall 72 is in electrical communication with the indicator 16. As a result, when a circuit is completed between the spring loaded contact 70 and contact wall 72, power is delivered from the power supply 54 through the spring loaded contact and contact wall 72 to the indicator 16. As was the case with the embodiment of FIG. 5, this arrangement will also achieve the security advantages described above.

Figure 7:
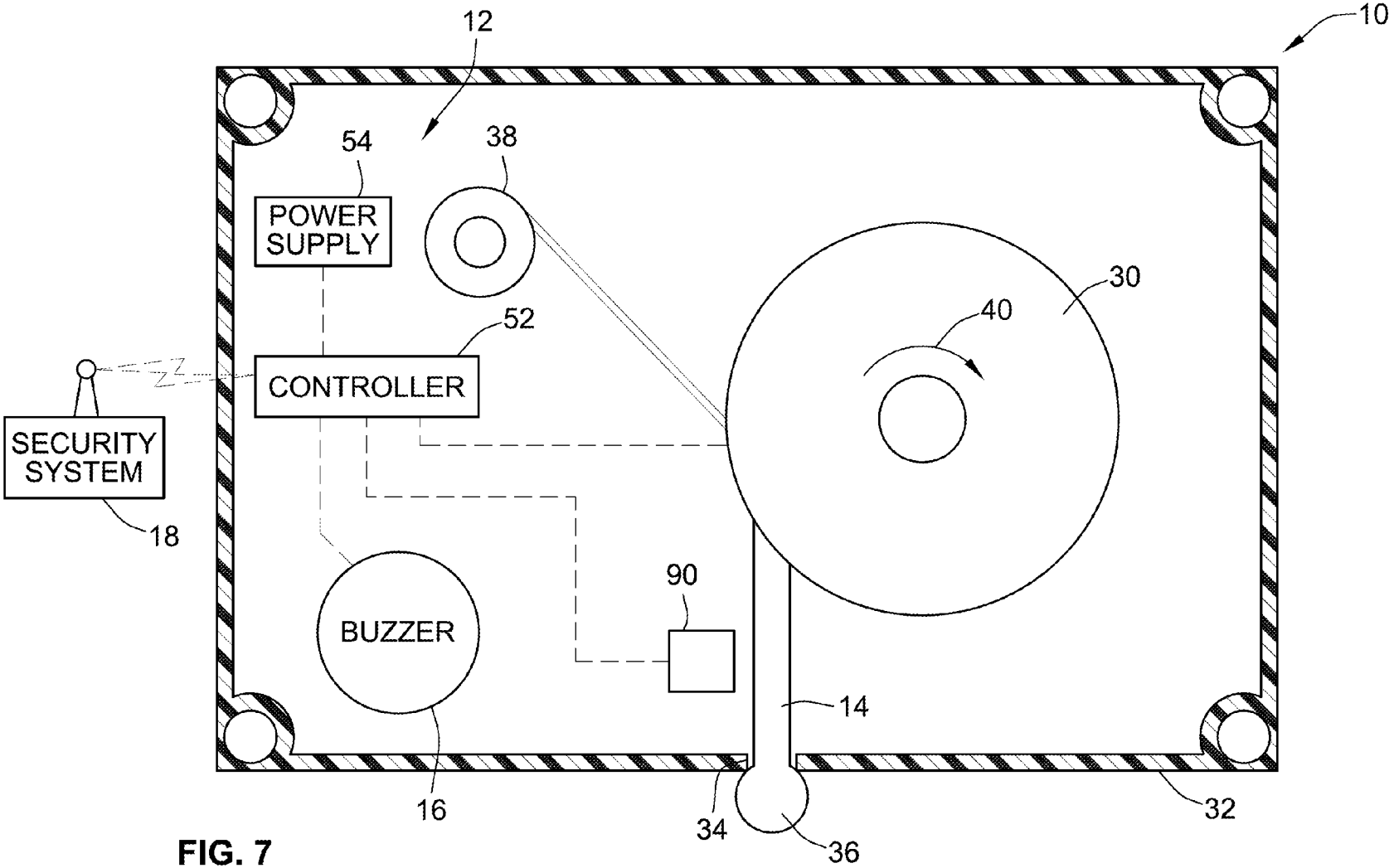
FIG. 7 is a front cross section of an embodiment of a retractable merchandise security tether with alarm incorporating a proximity sensor.

It will be recognized that in all the embodiments described above, the sensor is generally an electrical switch. However, other sensors are indeed contemplated. For example, and with reference now to FIG. 7, a sensor may be in the form of a proximity sensor 90. The proximity sensor 90 is arranged in proximity to the tether 14. The proximity sensor 90 is operable to detect the presence of the tether 14 as it extends to the opening 34 of the housing 32. However, in the event the tether 14 is severed and the spool winds the tether 14 in winding direction 40, the tether will no longer be in the same proximity to proximity sensor 90. As a result, the controller 52 electronically coupled to the proximity sensor 90 will detect this condition and send the appropriate indication to indicator 16 and provide same or similar alarm notifications as described above.

Figure 8:
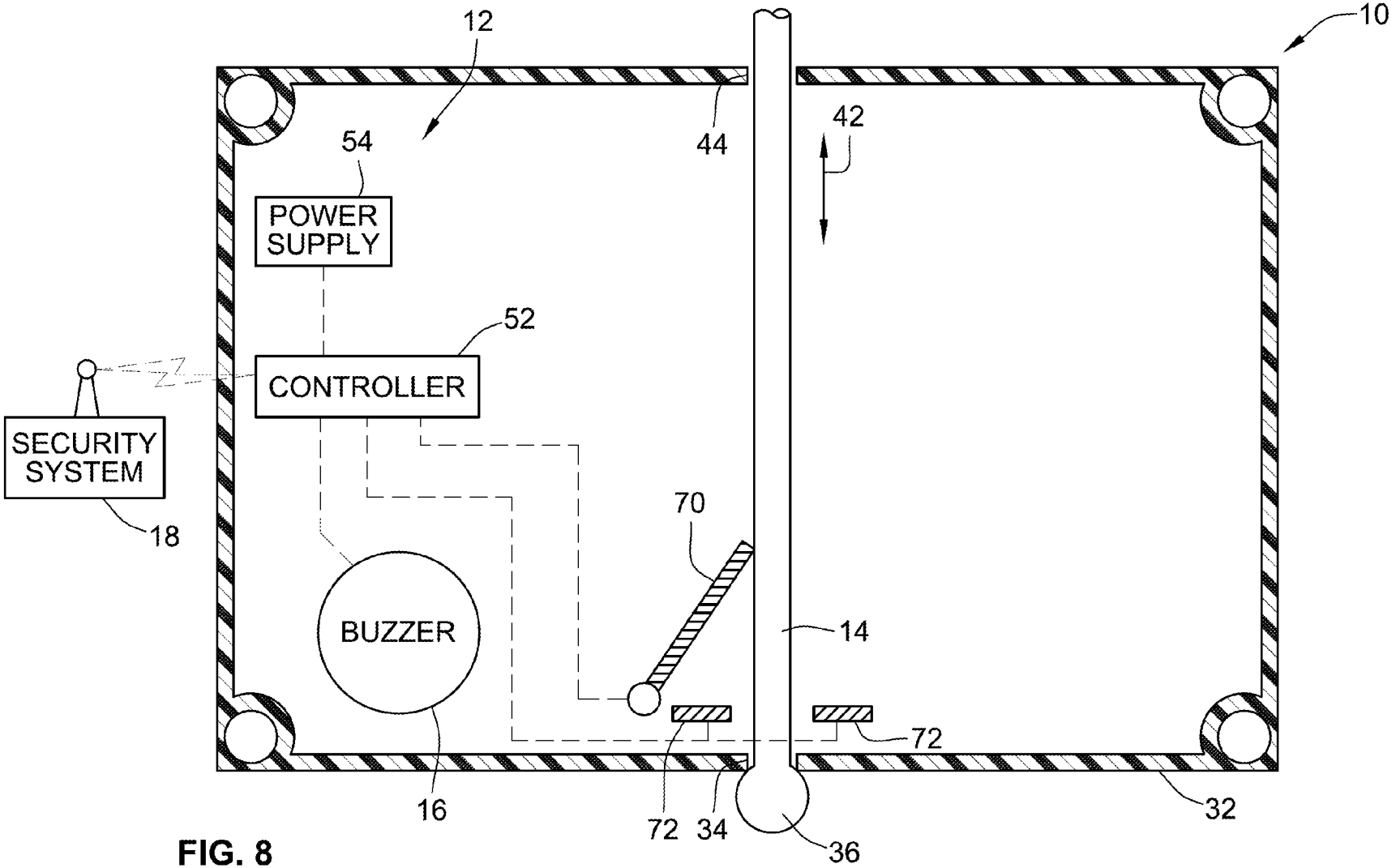
FIGS. 8-9 are front cross sections of an embodiment of a retractable merchandise security tether with an alarm that does not incorporate an internal spool carrying a tether.
Figure 9:
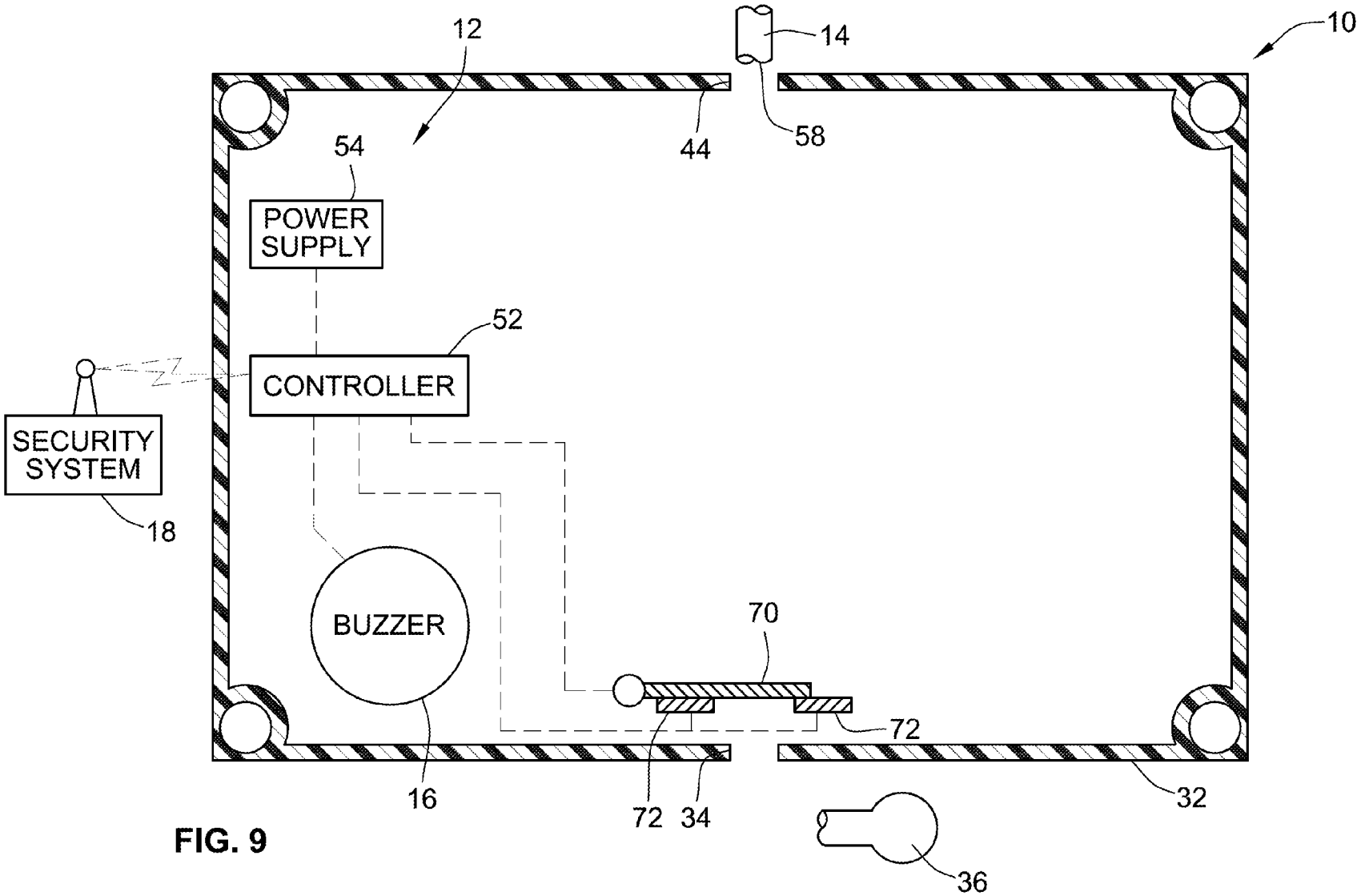

With reference now to FIGS. 8 and 9, yet another embodiment of a security tether device 10 is illustrated. This embodiment is similar to those described above, but omits a stand alone spool 30 (see FIG. 1) and tether 14 (see FIG. 1). With reference to FIG. 8, this embodiment is envisioned to operate as a "drop-in" or "retro fit" solution.

More specifically, as illustrated at FIG. 8, this embodiment includes a housing 32 with a pair of aligned openings 34, 44. An existing tether 14 is allowed to extend between the openings such that the tether 14 extends through the housing 32. The tether 14 is moveable relative to the housing along direction axis 42.

This embodiment includes a controller 52 in electrical communication with a spring loaded contact 70 and contact walls 72. The controller 52 is also in electronic communication with an indicator 16 and a power supply 54.

Similar to the embodiment described above relative to FIGS. 3 and 4, the controller 52 is operable to detect the completion of an electrical circuit between the spring loaded contact 70 and contact wall 72. Thereafter, the controller 52 is operable to provide an alert notification via the indicator 16 or wirelessly communicate with a security system 18 generally in a same or similar manner as described above. It will further be recognized from the above that this embodiment may entirely omit the controller 52 and simply provide an electrical circuit that can be selectively completed between the power supply and indicator 16 via the contact between the spring loaded contact 70 and contact walls 72.

In the illustrated embodiment of FIG. 8, the tether 14 is at its operating length. As a result, the tether will not freely retract through the housing 32 and more specifically the aligned openings 34, 44. Accordingly, the spring loaded contact 70 remains out of contact with the contact wall 72 by virtue of the presence of the tether 14.

However, with reference now to FIG. 9, in the event the tether 14 becomes severed as illustrated by severed end 58, the same will pass through the opening 34 and eventually break contact with the spring loaded contact 70. When this occurs, the spring loaded contact 70 will bias shut against the contact wall 72. As a result, an electrical circuit will be completed, and the controller 52 will detect such completion. Thereafter, the controller 52 will provide the aforementioned indication via indicator 16, communicate with the security system 18, or a combination of both. It will be recognized that although illustrated passing through both openings 34, 44, the severed end 58 need only clear the first opening 34 as well as the spring loaded contact 70 for the spring loaded contact 70 to make contact with the contact wall 72.

It will be recognized from the foregoing description relative to FIGS. 8 and 9, that such an embodiment may be mounted with a preexisting tether that may or may not otherwise incorporate an alarm system. This allows a retailer to achieve the advantages described herein without the need to replace an existing retail display incorporating a single or plurality of retractable tethers.

Having described the structural configurations of various embodiments of the instant invention, the following provides a detailed description of the operation of the same.

To place the security tether device 10 into operation, merchandise is affixed to an unsevered end of the tether 14. The merchandise can then be moved toward and away from the remainder of the security tether device 10. As the merchandise is so moved, the tether 14 will extend and retract out of and into the housing 32 respectively. However, in the event the tether is severed, the security module 12 will detect the same and provide an appropriate notification by way of the indicator 16. Additionally, the security device 12 may send a wired or wireless signal to a security system 18 of a retail store to aid in the appropriate response in detecting severance of the tether 14.

As described herein, embodiments of the present invention provide a new and improved device and method for securing retail merchandise using a retractable tether. Embodiments of the present invention described herein overcome existing problems in the art by deterring a would be thief's ability to simply sever a tether and thereafter remove merchandise from the retail store.

All references, including publications, patent applications, and patents cited herein are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims) is to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

What is claimed is:

1. A retail merchandise security tether, comprising:

a housing having an internal cavity;

an extendable and retractable tether extending from the internal cavity of the housing, the tether adapted to secure an item of retail merchandise;

a security module mounted to the housing, the security module operable to detect the presence of a severed end of the tether within the housing;

wherein the security module includes a sensor in electronic communication with an indicator, the sensor mounted to the housing to detect the presence of a severed end of the tether, and wherein the indicator is adapted to provide an indication upon detection of the severed end;

wherein the sensor includes a pair of electrical contacts, and wherein the tether has an operating length and a severed length shorter than the operating length, wherein the pair of electrical contacts do not contact one another et the tether is at the operating length;

wherein the pair of electrical contacts do contact one another when the tether is at the severed length; and wherein the housing has an opening, and wherein one of the pair of electrical contacts is formed by a spring loaded door arranged relative to the opening, and the other one of the pair of electrical contacts is a contact wall arranged about the opening such that the spring loaded door will bias shut over the opening and contact the contact wall when the tether is at the severed length.

2. The retail merchandise security tether of claim 1, wherein the indication provided by the indicator is at least one of a visual or audible indication.

3. The retail merchandise security tether of claim 1, wherein the security module is operably configured to communicate with a security system.

4. A retail merchandise security tether, comprising:

a housing having an opening;

an extendable and retractable tether mounted on a spool carried within the housing, the tether extending through the opening;

a sensor mounted to the housing and arranged about the opening, the sensor operable to detect movement of a severed end of the tether from an exterior of the housing to an interior of the housing through the opening;

wherein the sensor is a pair of electrical contacts;

wherein each one of the pair of electrical contacts are in electrical communication with a controller of the retail merchandise tether, the controller operable to detect when the pair of contacts are open and closed, and wherein the controller is configured to send a signal to an indicator to provide an alert notification when the pair of contacts are closed;

wherein one of the pair of electrical contacts is a wall substantially surrounding the spool, the wall having a wall opening formed therein to permit extension and retraction of the tether through the opening of the housing; and wherein the other one of the pair of electrical contacts is the tether.

5. The retail merchandise security tether of claim 4, wherein the alert notification provided by the indicator is at least one of a visual or audible notification.

6. The retail merchandise security tether of claim 4, wherein the controller is operably configured to communicate with a security system.

7. A retail merchandise security tether, comprising:

a housing having an opening;

an extendable and retractable tether mounted on a spool carried within the housing, the tether extending through the opening;

a sensor mounted to the housing and arranged about the opening, the sensor operable to detect movement of a severed end of the tether from an exterior of the housing to an interior of the housing through the opening;

wherein the sensor is a pair of electrical contacts;

wherein each one of the pair of electrical contacts are in electrical communication with a controller of the retail merchandise tether, the controller operable to detect when the pair of contacts are open and closed, and wherein the controller is configured to send a signal to an indicator to provide an alert notification when the pair of contacts are closed;

wherein one of the pair of electrical contacts is a movable door positioned over the opening of the housing and operable to close off the opening upon the retraction of the severed end of the tether from the exterior of the housing into the interior of the housing, and wherein the second contact is a contact wall positioned around the opening.

8. The retail merchandise security tether of claim 7, wherein the alert notification provided by the indicator is at least one of a visual or audible notification.

9. The retail merchandise security tether of claim 7, wherein the controller is operably configured to communicate with a security system.

10. A security device for a retail merchandise tether, comprising:

a housing including a first opening, the housing defining a tether passageway;

a security module mounted within the housing, the security module including a sensor arranged about the opening to detect the presence of the merchandise tether;

wherein the sensor includes a first and a second electrical contact;

wherein the first electrical contact is a spring loaded contact arranged over the first opening and the second electrical contact is a contact wall arranged adjacent to the first opening such that the presence of the tether through the first opening prevents the spring loaded contact from contacting the contact wall.

11. The security device of claim 10, wherein the security module includes a controller, the controller in electronic communication with both of the first and second contacts such that the controller detects when the first and second contacts are in an abutted contact and when the first and second contacts are not in abutted contact.

12. The security device of claim 11, further comprising an indicator in operable communication with sensor to provide an indication when the first and second contacts are in abutted contact, and wherein the indication provided by the indicator is at least one of a visual or audible indication.

13. The security device of claim 10, wherein the tether passageway includes an inlet and an outlet, wherein the inlet is the first opening and the outlet is a second opening through the housing in opposed spaced relation to the first opening such that the first and second openings are formed on opposing sides of the housing and arranged to permit movement of the tether relative to the housing.

14. The security device of claim 11, wherein the controller is operably configured to communicate with a security system.

* * * * *

UNITED STATES PATENT AND TRADEMARK OFFICE

CERTIFICATE OF CORRECTION

PATENT NO. : 8,604,927 B2
APPLICATION NO. : 13/081695
DATED : December 10, 2013
INVENTOR(S) : Scott W. Sisney It is certified that error appears in the above-identified patent and that said Letters Patent is hereby corrected as shown below:

In the Specification

In column 8, line 58, “et” should be changed to --when--.

Signed and Sealed this
Sixth Day of May, 2014

Michelle K. Lee

Michelle K. Lee
*Deputy Director of the United States Patent and Trademark Office*